US009106036B2

(12) United States Patent
Yang

(10) Patent No.: US 9,106,036 B2
(45) Date of Patent: Aug. 11, 2015

(54) ELECTRICAL CONNECTOR

(71) Applicant: Cheng Uei Precision Industry Co., Ltd., New Taipei (TW)

(72) Inventor: Chih-Lin Yang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 19 days.

(21) Appl. No.: 14/156,446

(22) Filed: Jan. 15, 2014

(65) Prior Publication Data

US 2015/0200501 A1 Jul. 16, 2015

(51) Int. Cl.
*H01R 13/648* (2006.01)
*H01R 24/60* (2011.01)

(52) U.S. Cl.
CPC ..... *H01R 24/60* (2013.01)

(58) Field of Classification Search
USPC ..... 439/607.32, 607.35, 607.36, 607.53, 439/607.54
IPC .... H01R 23/6873,23/7073, 23/7063, 13/65802, H01R 13/658
See application file for complete search history.

(56) References Cited

U.S. PATENT DOCUMENTS

| | | | | |
|---|---|---|---|---|
| 7,824,220 | B2 * | 11/2010 | Chen | 439/607.35 |
| 8,202,120 | B2 * | 6/2012 | Ko | 439/607.35 |
| 8,506,332 | B2 * | 8/2013 | Sommers et al. | 439/607.34 |
| 8,926,367 | B2 * | 1/2015 | Hsu | 439/607.35 |

* cited by examiner

*Primary Examiner* — Hien Vu
(74) *Attorney, Agent, or Firm* — Cheng-Ju Chiang

(57) ABSTRACT

An electrical connector includes an insulating housing, a plurality of terminals and a shielding shell. The insulating housing has a top wall, a bottom wall, a rear wall and two side walls together forming an inserting chamber thereamong. The top wall and the bottom wall respectively define a plurality of first terminal grooves and second terminal grooves which are opened symmetrically about the inserting chamber and communicate with the inserting chamber. The terminals include the first terminals and the second terminals. The first terminals and the second terminals are respectively inserted frontward in the first terminal grooves and the second terminal grooves of the insulating housing to be arranged in two rows in vertical direction. The first terminals and the second terminals are symmetrical in structure and arrangement about the inserting chamber. The shielding shell encloses the insulating housing.

10 Claims, 3 Drawing Sheets

ELECTRICAL CONNECTOR

BACKGROUND OF THE INVENTION

1. Field of the Invention

The present invention relates to a connector, and more particularly to an electrical connector.

2. the Related Art

Nowadays, electrical connectors are widely used in electronic products to realize signal transmission between the electronic products and corresponding peripheral equipments thereof. In order to meet market requirements, the electrical connectors are being at the period of mass production. With the rapid development of electronic technology, the electrical connector is required to give consideration to both high speed information transmission rate and miniaturization structure. However, the electrical connector is often mated with a mating connector in a single direction for insertion. As a result, users need to recognize both positive and negative directions of the electrical connector firstly before using the electronic product. It is inconvenient for the users.

SUMMARY OF THE INVENTION

Accordingly, an object of the present invention is to provide an electrical connector. The electrical connector includes an insulating housing, a plurality of terminals and a shielding shell. The insulating housing has a top wall, a bottom wall, a rear wall and two side walls together form an inserting chamber thereamong. The top wall and the bottom wall respectively define a plurality of first terminal grooves and second terminal grooves which are opened symmetrically about the inserting chamber and communicate with the inserting chamber. The first terminal grooves and the second terminal grooves are arranged at regular intervals along transverse directions of the top wall and the bottom wall respectively and each extending along a longitudinal direction to further penetrate rearward through the rear wall of the insulating housing. The terminals include a plurality of first terminals and a plurality of second terminals. The first and second terminals are respectively inserted frontward in the first and second terminal grooves of the insulating housing to be arranged in two rows in vertical direction. The first terminals each has a first fastening strip, a first elastic portion and a first soldering portion which are connected with two opposite ends of the first fastening strip. The first soldering portion is formed by a rear end of the first fastening strip extending downward and then bent rearward. The second terminals each has a second fastening strip, a second elastic portion and a second soldering portion which are connected with two opposite ends of the second fastening strip. The second soldering portion is formed by a rear end of the second fastening strip extending downward and then bent rearward. The first elastic portions and the second elastic portions are symmetrical in structure and arrangement about the inserting chamber. The first fastening strips and the first soldering portions are longer than the second fastening strips and the second soldering portions respectively. The first soldering portions and the second soldering portions are arranged in two rows in horizontal direction and the first soldering portions are located in front of the second soldering portions. The shielding shell includes a top plate, a rear plate and two side plates which are bent and extend downward from rear and side edges of the top plate. The shielding shell encloses the insulating housing.

As described above, the first terminals and the second terminals of the electrical connector of the embodiment of the present invention are assembled in the insulating housing with the first elastic portions and the second elastic portions being symmetrical in structure and arrangement about the inserting chamber. Therefore, users don't need to recognize positive and negative directions of the electrical connector specially when using the electrical connector. It improves the convenience for the users greatly.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
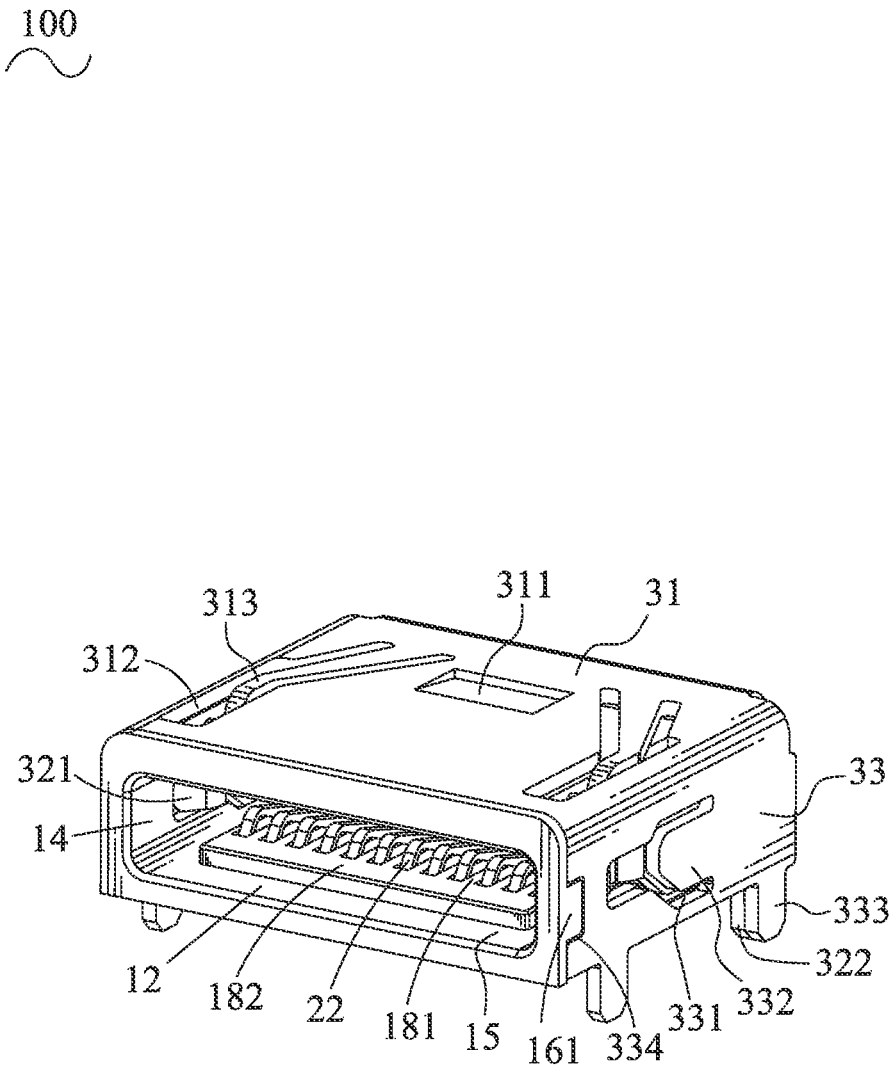
FIG. 1 is an assembled, perspective view of an electrical connector in accordance with an embodiment of the present invention.
Figure 2:
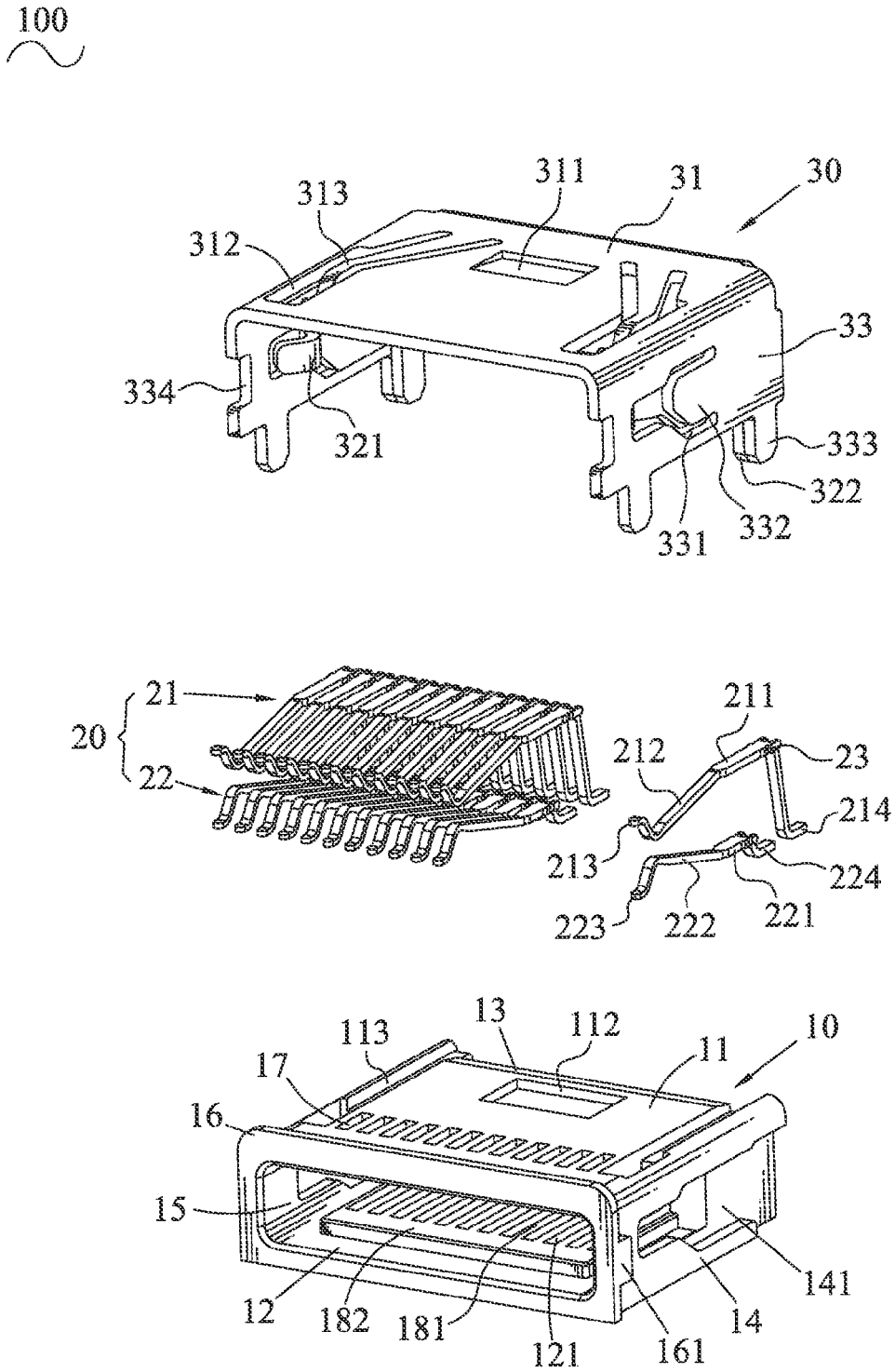
FIG. 2 is an exploded, perspective view of the electrical connector shown in FIG. 1.

Referring to the drawings in greater detail, and first to FIG. 1 and FIG. 2, an embodiment of the present invention is embodied in an electrical connector 100. The electrical connector 100 includes an insulating housing 10, a plurality of terminals 20 and a shielding shell 30.

Figure 3:
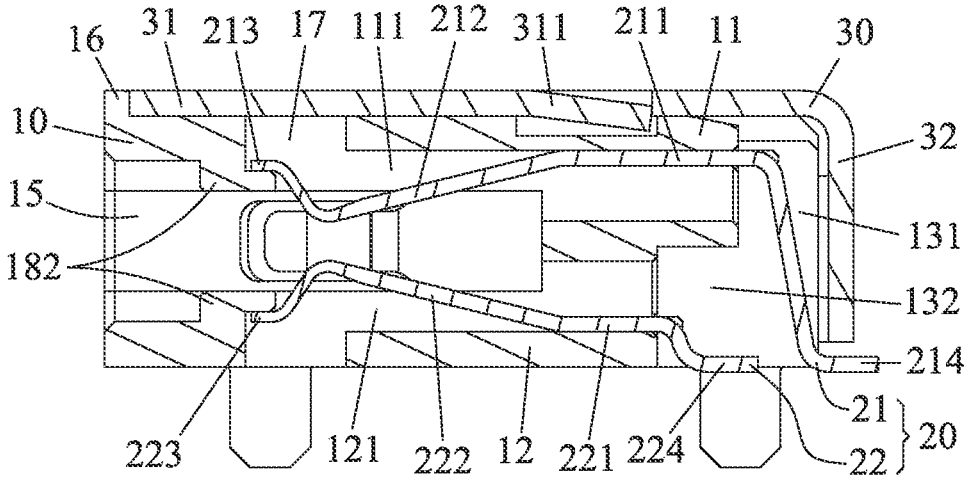
FIG. 3 is a cross-sectional view of the electrical connector shown in FIG. 1.

Referring to FIG. 2 and FIG. 3, the insulating housing 10 has a top wall 11, a bottom wall 12, a rear wall 13 and two side walls 14 together form an inserting chamber 15 thereamong. The top wall 11 and the bottom wall 12 respectively define a plurality of first terminal grooves 111 and second terminal grooves 121 which are opened symmetrically about the inserting chamber 15 and communicate with the inserting chamber 15. The first terminal grooves 111 and the second terminal grooves 121 are arranged at regular intervals along the transverse directions of the top wall 11 and the bottom wall 12 respectively and each extends along a longitudinal direction to further penetrate rearward through the rear wall 13 of the insulating housing 10. A rear middle of a top face of the top wall 11 is concaved downward to from a recess 112. Two opposite sides of the top wall 11 are concaved downward and penetrate rearward through the rear wall 13 of the insulating housing 10 to form a pair of slide slots 113 and the front ends of the slide slots 13 penetrate downward through the bottom face of the top wall 11. Front ends of the top wall 11 and the side walls 14 protrude outward to form a blocking rib 16 of inverted-U shape of which two vertical parts protrude rearward to form a pair of lumps 161 at substantial middles thereof. Front ends of the first terminal grooves 111 and the second terminal grooves 121 are vertically spread through the top wall 11 and the bottom wall 12 respectively to form a plurality of slots 17. Two blocking eaves 181 are protruded on a bottom side of the top wall 11 and a top side of the bottom wall 12 and transversely over the front ends of the first terminal grooves 111 and the second terminal grooves 121, respectively. The bottom side of the top wall 11 and the top side of the bottom wall 12 further protrude towards the inserting chamber 15 to form a plurality of partitions 182 arranged alternately with the first terminal grooves 111 and the second terminal grooves 121 respectively and each extending longitudinally to connect between the corresponding blocking eave 181 and a front side of the rear wall 13. A rear face of the rear wall 13 is concaved forward to form a receiving cavity 131 communicating with rear ends of the first terminal grooves 111 and penetrating through a bottom face of the rear wall 13 and further concaved forward to form an extending cavity 132 communicating with rear ends of the second terminal grooves 121 and penetrating through a bottom face of the rear wall 13. Two opposite outsides of the side walls 14 of the insulating housing 10 are concaved inward through the side walls 14 to form a pair of through grooves 141 with front ends thereof communicating with the inserting chamber 15 and rear ends thereof being freely opened.

The terminals 20 include a plurality of first terminals 21 and a plurality of second terminals 22. The first terminals 21 each has a first fastening strip 211, a first elastic portion 212 and a first soldering portion 214 which are connected with two opposite ends of the first fastening strip 211. The first elastic portion 212 is meandered frontward from a front end of the first fastening strip 211 to substantially show a V-shape and a front end of the first elastic portion 212 of the first terminal 21 extends forward to form a first blocking portion 213. The first soldering portion 214 is formed by a rear end of the first fastening strip 211 extending downward and then being bent rearward. The second terminals 22 each has a second fastening strip 221, a second elastic portion 222 and a second soldering portion 224 which are connected with two opposite ends of the second fastening strip 221. The second elastic portion 222 is meandered frontward from a front end of the second fastening strip 221 to substantially show an inverted-V shape and a front end of the second elastic portion 222 of the second terminal 22 extends forward to form a second blocking portion 223. The second soldering portion 224 is formed by a rear end of the second fastening strip 221 extending downward and then being bent rearward. The first elastic portions 212 of the first terminals 21 and the second elastic portions 222 of the second terminals 22 are symmetrical in structure and arrangement about the inserting chamber 15. The first fastening strips 211 and the first soldering portions 214 are longer than the second fastening strips 221 and the second soldering portions 224 respectively. The first soldering portions 214 and the second soldering portions 224 are arranged in two rows in horizontal direction and the first soldering portions 214 are located in front of the second soldering portions 224. Two opposite side edges of each rear end of the first fastening strip 211 of the first terminal 21 and the second fastening strip 221 of the second terminal 22 protrude sideward to form a pair of barbs 23.

The shielding shell 30 has a top plate 31, a rear plate 32 and two side plates 33 which are bent and extend downward from rear and side edges of the top plate 31. A rear middle of the top plate 31 is die-cut downward to form an inclined buckling portion 311 corresponding to the recess 112 of the top wall 11 of the insulating housing 10. Two opposite sides of the top plate 31 are defined a pair of fillisters 312 and at the rear ends of the fillisters 312 protruded forward to form a pair of elastic slices 313 and distal ends of the elastic slices 313 elastically project into the inserting chamber 15. The side plates 33 of the shielding shell 30 are opened with a pair of openings 331 corresponding to the through grooves 141 of the insulating housing 10. A rear edge of each opening 331 extends frontward to form a strengthen slice 332. Two opposite ends of the side plates 33 of the shielding shell 30 protruded downward to form a plurality of soldering pins 333. A front edge of each side plate 33 of the shielding shell 30 is concaved rearward to form a notch 334 corresponding to the lump 161 of the insulating housing 10. Two opposite sides of the rear plate 32 of the shielding shell 30 are bent frontward and then extending to form a pair of elastic arms 321 corresponding to the through grooves 141 of the insulating housing 10 and the front ends of the elastic arms 321 are arched inward and projecting beyond the inside face of the side plates 33 of the shielding shell 30. The elastic arms 321 of the shielding shell 30 protruded downward to form a pair of soldering feet 322 corresponding to the soldering pins 333 in rear ends of the side plates 33 of the shielding shell 30.

Referring to FIG. 2 and FIG. 3, in assembly, the first and second terminals 21, 22 are respectively inserted frontward in the first and second terminal grooves 111, 121 of the insulating housing 10 to be arranged in two rows in vertical direction. The first fastening strips 211 of the first terminals 21 are fixed in the first terminal grooves 111 and the barbs 23 of each first fastening strip 211 resist against inner sidewalls of the first terminal groove 111 to secure the first terminal 21 in the first terminal groove 111. The first elastic portions 212 project downward into the inserting chamber 15, and the first blocking portions 213 elastically resist against a top side of the blocking eave 181 and are movable in the corresponding slots 17 in vertical direction. The first soldering portions 214 are partially received in the receiving cavity 131 and have distal ends thereof project rearward behind the rear wall 13. The second fastening strips 221 of the second terminals 22 are fixed in the second terminal grooves 121 and the barbs 23 of each second fastening strip 221 resist against inner sidewalls of the second terminal groove 121 to secure the second terminal 22 in the second terminal groove 121. The second elastic portions 222 project upward into the inserting chamber 15 and are symmetrical with the first elastic portions 212 in structure and arrangement about the inserting chamber 15. The second blocking portions 223 elastically resist against a bottom side of the blocking eave 181 and are movable in the corresponding slots 17 in vertical direction. The second soldering portions 224 are partially received in the extending cavity 132 and have distal ends thereof project into the receiving cavity 131.

The shielding shell 30 is assembled forward to the insulating housing 10 until front edges of the top plate 31 and the side plates 33 are blocked against the blocking rib 16 and the lumps 161 are held in the notches 334 of the side plates 33. The elastic slices 313 of the top plate 31 of the shielding shell 30 are received in the slide slots 113 of the insulating housing 10 and the arch of the elastic slices project beyond the bottom face of the top plate 31 of the shielding shell 30. In the embodiment of the present invention, the elastic slices 313 of the shielding shell 30 connecting to the shell of the butting connector (not shown) to play a part in ESD (Electro-Static Discharge) and EMI (Electro-Magnetic Interference) protections. The buckling portion 311 of the shielding shell 30 is buckled in the recess 112 of the insulating housing 10 to prevent the shielding shell 30 away from the insulating housing 10. The elastic arms 321 of the rear plate 32 of the shielding shell 30 are held in the through grooves 141 of the side walls 14 of the insulating housing 10 and the distal ends of the elastic arms 321 elastically project face-to-face into the inserting chamber 15. The soldering feet 322 of the shielding shell 30 are held in the rear ends of the through grooves 141 of the insulating housing 10. The strengthen slices 332 of the shielding shell 30 are located out of the elastic arms 321. The soldering pins 333 of the rear ends of the side plates 33 of the shielding shell 30 are located out of the soldering feet 322 and together soldered in the PCB (Printed Circuit Board).

As described above, the first terminals 21 and the second terminals 22 of the electrical connector 100 of the embodiment of the present invention are assembled in the insulating housing 10 with the first elastic portions 212 and the second elastic portions 222 being symmetrical in structure and arrangement about the inserting chamber 15. Therefore, users don't need to recognize positive and negative directions of the electrical connector 100 specially when using the electrical connector 100. It improves the convenience for the users greatly.

What is claimed is:

1. An electrical connector, comprising:

an insulating housing having a top wall, a bottom wall, a rear wall and two side walls together forming an inserting chamber thereamong, the top wall and the bottom wall respectively defining a plurality of first terminal grooves and second terminal grooves which are opened symmetrically about the inserting chamber and communicate with the inserting chamber, the first terminal grooves and the second terminal grooves being arranged at regular intervals along transverse directions of the top wall and the bottom wall respectively and each extending along a longitudinal direction to further penetrate rearward through the rear wall of the insulating housing;

a plurality of terminals including a plurality of first terminals and a plurality of second terminals, the first and second terminals being respectively inserted frontward in the first and second terminal grooves of the insulating housing to be arranged in two rows in vertical direction, the first terminals each having a first fastening strip, a first elastic portion and a first soldering portion which are connected with two opposite ends of the first fastening strip, the first soldering portion being formed by a rear end of the first fastening strip extending downward and then being bent rearward, the second terminals each having a second fastening strip, a second elastic portion and a second soldering portion which are connected with two opposite ends of the second fastening strip, the second soldering portion being formed by a rear end of the second fastening strip extending downward and then being bent rearward, the first elastic portions and the second elastic portions being symmetrical in structure and arrangement about the inserting chamber, the first fastening strips and the first soldering portions being longer than the second fastening strips and the second soldering portions respectively, the first soldering portions and the second soldering portions being arranged in two rows in horizontal direction and the first soldering portions being located in front of the second soldering portions; and a shielding shell including a top plate, a rear plate and two side plates which are bent and extend downward from rear and side edges of the top plate, the shielding shell enclosing the insulating housing;

wherein two opposite sides of the top wall being concaved downward and penetrated rearward through the rear wall of the insulating housing to form a pair of slide slots and the front ends of the slide slots penetrated downward through the bottom face of the top wall, two opposite sides of the top plate being defined a pair of fillisters and at the rear ends of the fillisters protruded forward to form a pair of elastic slices and distal ends of the elastic slices elastically project into the inserting chamber, the elastic slices are received in the slide slots and the arch of the elastic slices project beyond the bottom face of the top plate.

2. The electrical connector as claimed in claim 1, wherein a rear face of the rear wall is concaved forward to form a receiving cavity communicating with rear ends of the first terminal grooves and penetrating through a bottom face of the rear wall and further concaved forward to form an extending cavity communicating with rear ends of the second terminal grooves and penetrating through a bottom face of the rear wall, the first soldering portions are partially received in the receiving cavity and have distal ends thereof project rearward behind the rear wall, the second soldering portions are partially received in the extending cavity and have distal ends thereof project into the receiving cavity.

3. The electrical connector as claimed in claim 1, wherein two opposite side edges of each rear end of the first fastening strip of the first terminal and the second fastening strip of the second terminal protrude sideward to form a pair of barbs, the barbs of the first fastening strip and the second fastening strip resist against inner sidewalls of the first terminal groove and the second terminal groove respectively.

4. The electrical connector as claimed in claim 1, wherein two blocking eaves are protruded on a bottom side of the top wall and a top side of the bottom wall and transversely over front ends of the first terminal grooves and the second terminal grooves, respectively, the bottom side of the top wall and the top side of the bottom wall further protrude towards the inserting chamber to form a plurality of partitions arranged alternately with the first terminal grooves and the second terminal grooves respectively and each extending longitudinally to connect between the corresponding blocking eave and a front side of the rear wall, a front end of the first elastic portion of the first terminal extends forward to form a first blocking portion, a front end of the second elastic portion of the second terminal extends forward to form a second blocking portion, the first blocking portions and the second blocking portions elastically resist against top and bottom sides of the blocking eaves respectively.

5. The electrical connector as claimed in claim 4, wherein the front ends of the first terminal grooves and the second terminal grooves are vertically spread through the top wall and the bottom wall respectively to form a plurality of slots, the first blocking portions and the second blocking portions are movable in the corresponding slots in vertical direction.

6. The electrical connector as claimed in claim 1, wherein front ends of the top wall and the side walls protrude outward to form a blocking rib of inverted-U shape of which two vertical parts protrude rearward to form a pair of lumps at substantial middles thereof, a front edge of each side plate of the shielding shell is concaved rearward to form a notch corresponding to the lump of the insulating housing, the shielding shell is assembled forward to the insulating housing until front edges of the top plate and the side plates are blocked against the blocking rib and the lumps are held in the notches of the side plates.

7. The electrical connector as claimed in claim 1, wherein a rear middle of a top face of the top wall is concaved downward to from a recess, a rear middle of the top plate is die-cut downward to form an inclined buckling portion, the buckling portion of the shielding shell is buckled in the recess of the insulating housing.

8. The electrical connector as claimed in claim 1, wherein two opposite outsides of the side walls of the insulating housing being concaved inward through the side walls to form a pair of through grooves with front ends thereof communicating with the inserting chamber and rear ends thereof being freely opened, two opposite sides of the rear plate of the shielding shell being bent frontward and then extending to form a pair of elastic arms corresponding to the through grooves of the insulating housing and the front ends of the elastic arms being arched inward and projecting beyond the inside face of the side plates of the shielding shell, the elastic arms are held in the through grooves and the distal ends of the elastic arms elastically project face-to-face into the inserting chamber.

9. The electrical connector as claimed in claim 8, wherein the side plates of the shielding shell being opened with a pair of openings corresponding to the through grooves of the insulating housing, a rear edge of each opening being extended frontward to form a strengthen slice, the strengthen slices are located out of the elastic arms.

10. The electrical connector as claimed in claim 8, wherein two opposite ends of the side plates of the shielding shell being protruded downward to form a plurality of soldering pins, the elastic arms of the shielding shell being protruded downward to form a pair of soldering feet corresponding to the soldering pins in rear ends of the side plates of the shielding shell, the soldering pins of the rear ends of the side plates are located out of the soldering feet.

* * * * *